United States Patent [19]

Prucyk

[11] 4,196,854

[45] Apr. 8, 1980

[54] TRUCK MOUNTED HOT LINE PAVEMENT STRIPING SYSTEMS

[75] Inventor: Martin D. Prucyk, Norval, Canada

[73] Assignee: Roadline International Inc., Norval, Canada

[21] Appl. No.: 865,591

[22] Filed: Dec. 29, 1977

[51] Int. Cl.[2] ..... B05B 1/24; E01C 19/17

[52] U.S. Cl. ..... 239/129; 237/12.3 R; 239/130; 239/139

[58] Field of Search ..... 239/129, 130, 135, 139; 237/12.3 R, 12.3 A, 12.3 B, 12.3 C; 404/111

[56] References Cited

U.S. PATENT DOCUMENTS

| | | | |
|---|---|---|---|
| 1,059,647 | 4/1913 | Tarrant | 239/130 |
| 2,506,412 | 5/1950 | Chausse | 239/130 X |
| 3,092,325 | 6/1963 | Brown, Jr. et al. | 239/129 X |

FOREIGN PATENT DOCUMENTS

| | | | |
|---|---|---|---|
| 786486 | 9/1935 | France | 239/129 |
| 3276 | of 1915 | United Kingdom | 239/130 |

*Primary Examiner*—Robert B. Reeves
*Assistant Examiner*—Andres Kashnikow
*Attorney, Agent, or Firm*—Ivor M. Hughes

[57] ABSTRACT

A heating system is provided, for heating liquid in a truck mounted hot line pavement striping system, including a paint storage tank and spray guns, the heating system including a conduit from the internal combustion engine of the truck leading to a series of smaller conduits passing through the thermal oil bath, as the sole heat source for heating the oil bath, and thereafter being exhausted to the atmosphere, the inner walls of the tubes having sufficient heat exchanging surface, and of sufficient number to conduct sufficient heat from the exhaust gases through the conduit wall to the oil bath to heat the thermal oil, the oil surrounding tubes within the bath, containing the paint to be sprayed "hot" from the paint guns, and a heat by-pass from the engine to by-pass the heat past the heating system.

3 Claims, 3 Drawing Figures

TRUCK MOUNTED HOT LINE PAVEMENT STRIPING SYSTEMS

FIELD OF INVENTION

This invention relates to truck mounted hot line pavement striping systems.

BACKGROUND OF THE INVENTION

Truck mounted pavement stripers are well known in the art. One such truck mounted pavement striper employs paint stored at ambient temperature in pressurized storage tanks, and conducted from the tanks to pressurized paint guns for discharge onto the road areas to be striped. Unfortunately, the drying time for such paint exceeds 10 minutes and requires protection during the drying period from smudging and tracking by vehicles using the roads. To permit the paint to dry, marking cones are set down after painting, and then later retrieved by additional workmen, carried in a separate truck following a predetermined distance behind the truck mounted pavement striper.

As a result of the deficiencies of the above system, a more advanced hot line paint system was developed. In this system, hot paint is delivered "hot" from storage for discharge "hot" at the spray guns. Upon application, the "hot" paint dries in a matter of seconds. While the need for marking cones was eliminated, a new cost factor was added—the cost to heat the paint. While several methods of heating the paint have been proposed, none have been satisfactory from a cost and/or efficiency point of view. Particularly, one such method of heating the paint provided a diesel fuel fired water heater of sufficient capacity to heat water to a given temperature (below boiling) which in turn heats the paint to a temperature of between about 180°-190° F. However, firing with diesel fuel requires separate storage tanks mounted in the truck for the diesel fuel at additional cost. Furthermore, the source of heat is external, i.e. the diesel fuel. Additionally, the use of water limited the heat which could be transferred to the paint. There is of course, a source of heat that is internal, i.e. part of the truck, which heat has not been used to date to heat the paint but is released to the atmosphere—the heat from the exhaust systems of the internal combustion engines of the truck and compressors if any. Tests conducted by me at the exhausts of the motor and compressor if any, revealed that temperatures of the exhaust gases exceeded 580° F. While no one to date has succeeded in harnessing the exhaust gases to heat the paint, saying it could not be done, I have not only succeeded in utilizing such gases to provide the necessary heat to heat the paint, but also in providing such heat to the paint, I have been also able to provide heat in excess of the minimum necessary to achieve and maintain the paint "hot" in the system for spraying "hot" at the guns.

SUMMARY OF THE INVENTION

According to one aspect of the invention, I have provided a system for collecting the exhaust gases of internal combustion engines mounted on the truck and for conducting such gases as the only source of heat to heat a thermal oil bath surrounding tubes, suitably disposed with respect to the bath, containing the paint to be sprayed "hot" from the paint guns. Therefore, the exhaust gases heat the bath and the bath in turn heats the paint. To ensure that the bath and paint are not overheated, suitable by-passes are provided to pass heat not necessary for heating, to other areas of the system for use, or are passed through an exhaust to the atmosphere unused;

Thus exhaust gases from internal combustion engines on the truck are collected and conducted through a system of smaller tubes or conduits passing through the oil bath, exhausted to the atmosphere, the inner walls of the tubes having sufficient heat exchanging surface and of sufficient number to conduct sufficient heat from the exhaust gases through the tube walls to the oil bath to heat the oil, adjacent the system of conduits causing the heated oil to rise and be replaced by cooler oil, thus causing a convection current within the oil bath, the heated oil in turn being in communication with the outer walls of a conduit, carrying paint to be heated, suitably positioned in the bath, to be bathed by the heated oil, thereby heating the paint to the desired temperature prior to being conducted to the spray guns.

The invention will now be illustrated having regard to the following drawings of a preferred embodiment of the invention, and detailed description thereof.

BRIEF DESCRIPTION OF THE PREFERRED EMBODIMENT

Figure 1:
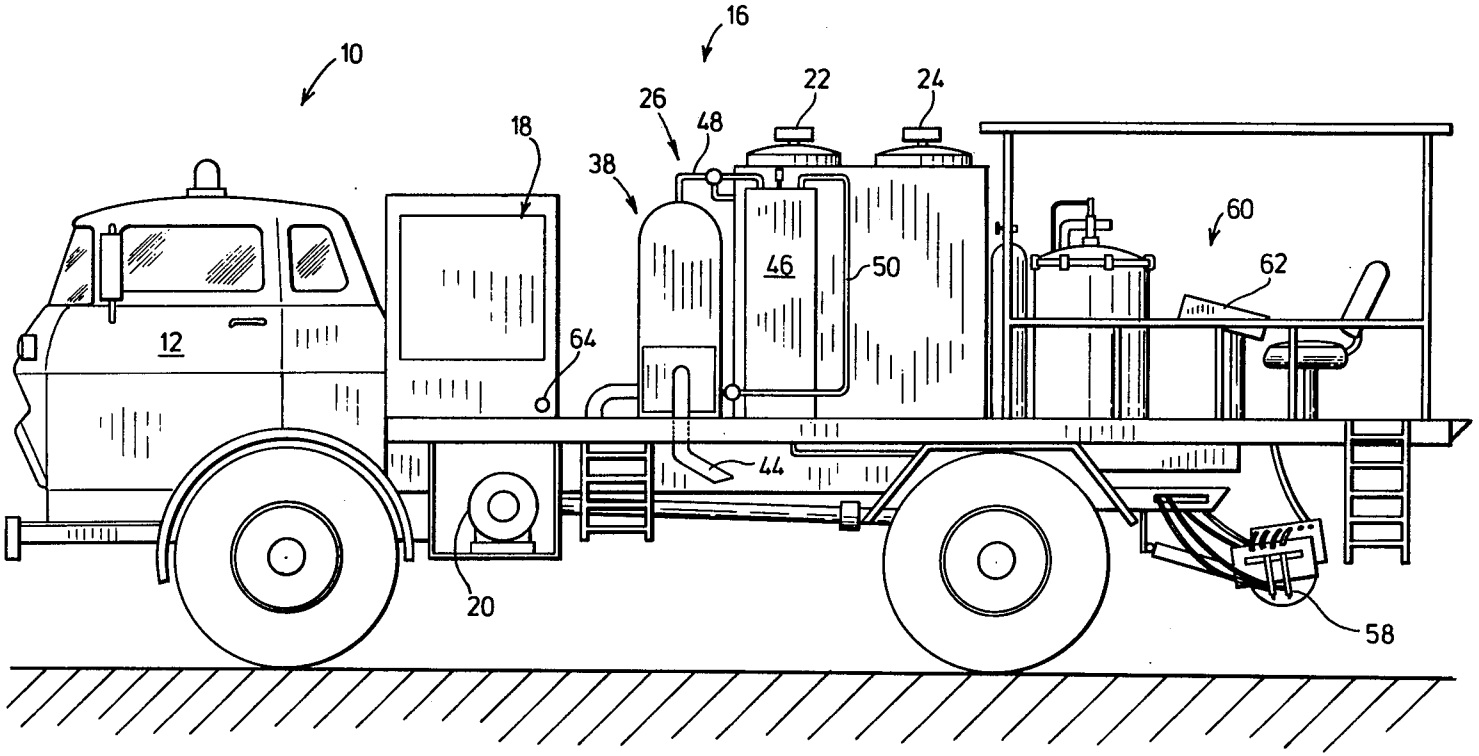
FIG. 1 illustrates a truck embodying a preferred embodiment of the invention.
Figure 2:
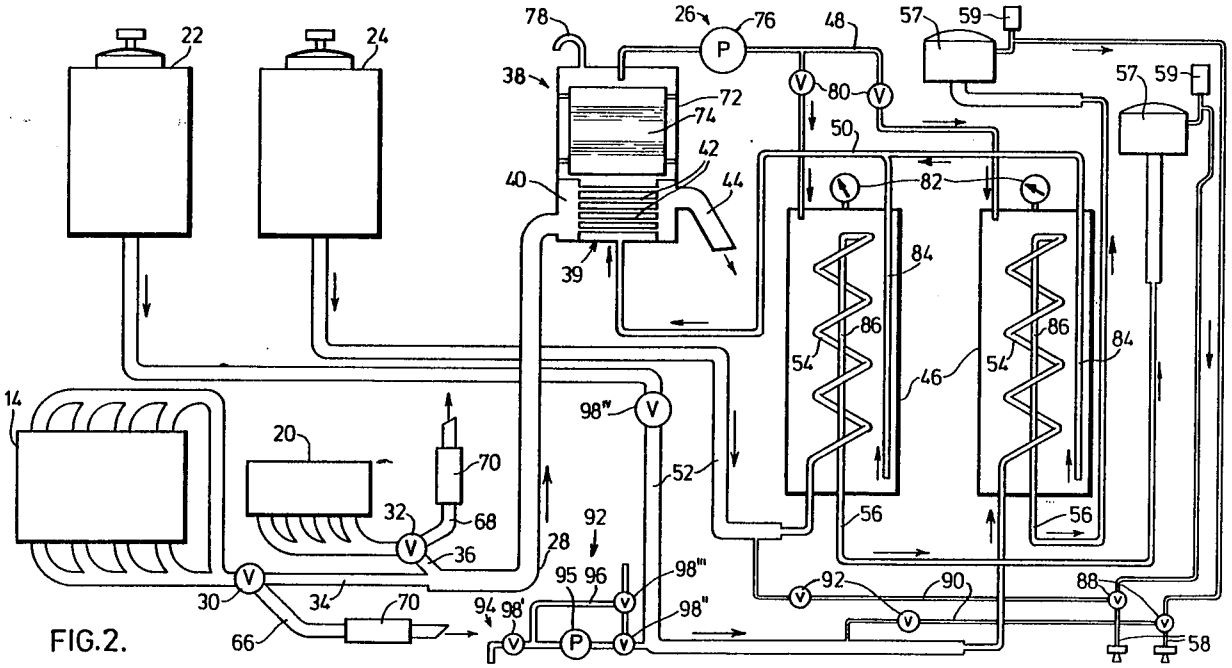
FIG. 2 is a schematic of the "hot" paint system, according to the preferred embodiment of the invention.
Figure 3:
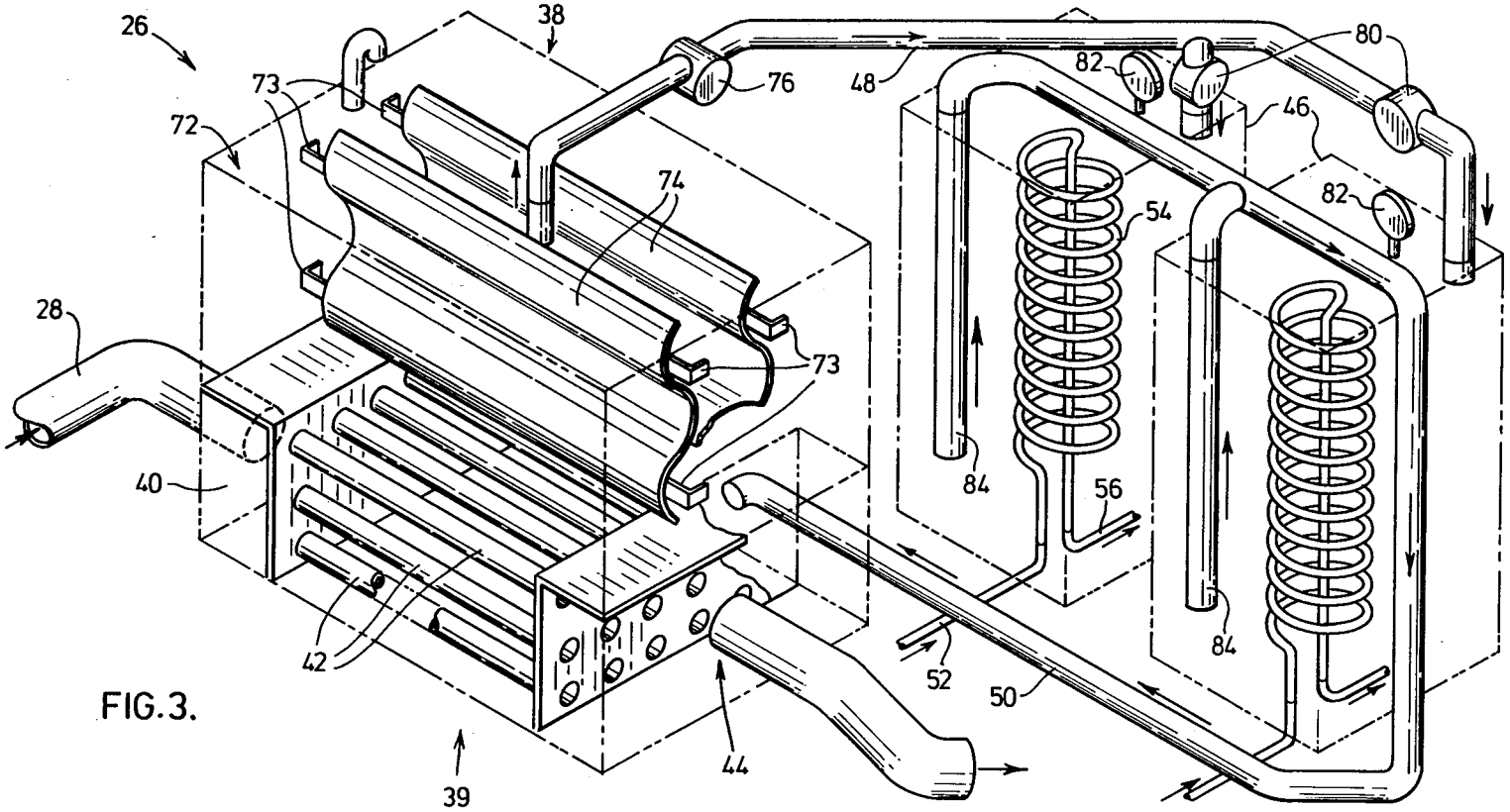
FIG. 3 is a close-up view of the components of the system shown in FIG. 2 used to heat the paint, according to the preferred embodiment.

With reference to FIGS. 1, 2, and 3, there is shown a C-900 Ford (T.M.) tilt cab truck 10, having cab 12, a 477 cubic inch internal combustion engine 14, and trailer 16 mounting, a Hercules (T.M.) compressor 18, having a 4-cylinder internal combustion engine 20; paint storage tanks 22 and 24; the heating system for heating the paint generally indicated as 26, consisting of (a) conduit 28 connected to engines 14 and 20 through by-pass valve 30 and 32 and outlets 34 and 36 respectively for collecting the exhaust gases from the engines; (b) oil reservoir 38 wherein oil substantially filling reservoir 38 is heated, oil reservoir 38 including exhaust inlet chamber 40 in direct communication with conduit 28, and a series of smaller tubes 42 disposed parallel to one another in the bottom 39 of reservoir 38 leading to outlet 44; (c) heat exchangers 46 connected to oil reservoir 38 by conduits 48 and 50, conduits 52 leading from paint storage tanks 22 and 24 into spiral coil conduits 54 in which the paint is heated, and outlet conduits 56 leading from coils 54 to high pressure airless GRACO (T.M.) Spray Guns 58; and controls 60 displayed in control panel 62 for controlling the paint system;

For heating the paint to the desired temperature of 200° F. and the maintenance of the paint at that temperature, exhaust gases exceeding 500° F. from the C-900 truck and Hercules (T.M.) compressor engines, are conducted through, by-pass valves 30 and 32 controlled by switch 64 (See FIG. 1) and 2" and 4" conduits 34 and 36 respectively, (rather than exhausted through exhausts 66 and 68 carrying mufflers 70 respectively). The gases are then combined in 6" conduit 28, so there has been no increase in the gas pressure, passed into chamber 40 and then through the thirty-six, 60" long, $1\frac{1}{2}$" diameter steel tubes 42, passing through the bottom 39 of reservoir 38, having a total inner tube wall heat conducting surface area of 26 square feet. After passing through tubes 42, the exhaust gases are exhausted from the system through conduit 44. While the drawings do not show insulation, each of conduits 34, 36 and 28, by-passes 30 and 32, and reservoir 38 are all suitably insulated, to minimize heat loss;

Heat reaching tubes 42 and passed through the wall of tubes 42, heats the thermal oil in reservoir 38 adjacent the tubes causing the oil to rise. The upper cavity portion 72 of reservoir 38 is subdivided into 3 sections by vertically oriented curved fins 74 welded to the outer side walls of reservoir 38 at 73. Therefore, heated oil rising between an outer wall generally parallel to fins 74 and one of fins 74 rises above the fin and falls over the fin into the volume between fins 74 while the heated oil rising between fins 74 is drawn into tube 48 by pump 76, thereby setting up a convection current in reservoir 38. Air outlet 78 permits entry or escape of air as the volume of oil in reservoir 38 fluctuates as the oil is heated. The heated oil is then directed into the top of either or both heat exchangers 46 by by-pass valves 80 as needed when the temperature of the oil shown on the thermometers 82 needs to be raised. As the oil cools, it descends to the bottom of the heat exchanger 46 from where it is drawn out by pipes 84 into return conduit 50 and then into the volume of the reservoir 38 adjacent tubes 42 whereat it is reheated and rises. Since the oil adjacent the top of the heat exchangers is the hottest, paint to be heated is pumped from either or both paint tanks 22 and 24 through conduits 52 into spiral coil 54 in heat exchangers 46. Therefore, the paint is heated as it climbs upwardly in the coil to its maximum temperature before it enters the down portion 86 from where it is directed through tube 56 by GRACO 207567 King (T.M.) pumps 57 and GREER Accummulators 59 to guns 58 through by-pass valves 88 for spraying, or for recirculating through conduit 90 and through valve by-passes 92 and conduits 52 through the paint system to prevent settling of the paint in the system and thus ensuring the paint does not harden in the system. Once again, since heat loss must be reduced, all components are insulated to minimize the heat loss.

For the purposes of cleaning the paint system or loading the paint tanks 22 and 24, like systems 92 are positioned in conduits 52, only one of which is shown in FIG. 2. Each system 92 consists of, inlet 94 joined to conduit 52 by by-pass 96, loading pump 95, and ball valves $98^{I}$, $98^{II}$, $98^{III}$, and ball valve $98^{IV}$ disposed in conduit 52. For the purposes of cleaning the system, valve $98^{IV}$ in conduit 52 and valve $98^{III}$ are closed to the conduit valves $98^{I}$, and $98^{II}$, opened to the system and toluol is loaded into the system by pump 95, circulated through conduit 56, helical conduit 54, down portion 86, through valves 88, return conduit 90 and off-loaded through inlet 94. For the purposes of loading paint, valve $98^{IV}$ is opened to the system and tank 22 is filled. In like manner, tank 24 is also loaded. Afterwards, pump 95 is cleaned by creating a closed circuit by opening valve $98^{III}$ and opening valve $98^{II}$ to be in communication through conduit 96A with valve $98^{III}$. Toluol is then circulated through pump 95.

For the purposes of painting hot, I maintain the temperature of the paint at the guns 58 at 200° F. To keep the paint at that temperature, I maintain the temperature reading at thermometers 82 mounted on exchangers 46 at 250° F., which means the oil adjacent the top of helical 54 adjacent thermometer 82 is the hottest. The ability of the system to heat the paint depends on the volume sprayed by the guns. The more paint sprayed, the greater the heat requirement. Therefore, in designing the preferred embodiment, the optimum flow rate of the paint through the system was determined. Since a paint truck moves at about 8 miles per hour during the painting operation it generates exhaust gases containing about 220,000 available B.T.U. of heat per hour from the 477 cubic inch truck engine (approximately another 110,000 available B.T.U. of heat per hour is available from the Hercules Compressor).

In calculating the dimensions of reservoir 38, tubes 42 and exchangers 46, I performed the following calculations based on the assumptions noted. Twenty-two gallons of paint are required to paint a solid mile long continuous line, whereas an interrupted mile long line requires about seven gallons. Therefore, for the purposes of determining heat necessary to heat paint to be used in any hour period of painting to 200° F. from ambient (~60° F. during the summer when most painting is done) during the painting operation, I have assumed 100 gallons having a weight of 1,667 pounds are sprayed per hour, having an assumed specific heat about the same as water. Therefore, the heat required to elevate the paint's temperature $\cong$233,300 B.T.U.

Therefore, 100 gallons of paint passing through heat exchanger 46 each hour must gain 233,300 B.T.U. from the oil bath. While the volume of the oil in the exchanger 46 is not critical the flow rate of the oil through exchanger 46 must be adjusted, to ensure the temperature reading on the thermometer is maintained at 250°. For the purposes of my calculations, I also assumed a drop in temperature of the oil from the top to the bottom of the exchanger of about 30° F. the temperature drop including heat for heating the paint, and an efficiency of the heat exchanger of about 90%. Therefore, the oil must be able to exchange $(10/9)\times 233{,}300 \cong 260{,}000$ B.T.U. per hour to enable the paint to absorb the necessary heat. For my purposes, I employ 160 gallons of oil in reservoir 38 and exchangers 46 the oil constantly being circulated in the closed system. In turn, the available heat in the oil, must be absorbed from the exhaust gases. In this regard, assuming an efficiency of 85%, the exhaust gases must supply $(20/17)\times 260{,}000=(520{,}000/17)\cong 310{,}000$ B.T.U. It is of course to be understood that the initial heat to heat the oil before any heating of the paint is usually accomplished when the truck is driving from the storage yard to the job site.

Since about 33,000 B.T.U. per hour can be transferred through 2.6 square feet of steel surface and about 310,000 B.T.U. per hour are required to heat the oil, 26 square feet of heat exchange surface area must be supplied on the interior of tubes 42 to pass the heat from the gases to the oil bath.

While the above calculations are essentially theoretical, they did form a basis for the construction of the heat exchange system. Therefore, to take into account variations in the heat transfer properties of the various components, I chose 36 tubes 42 having a diameter of 1½", disposed at the bottom of reservoir 38.

As many changes can be made in the preferred embodiments without departing from the scope of the invention or appended claims, it is intended that all matter contained in the description of the preferred embodiment be interpreted as illustrative of the invention, and not in a limiting sense.

The embodiments of the invention in which an exclusive property or privilege is claimed are as follows:

1. A heating system for mounting on a truck for heating paint in a truck mounted hot line pavement striping system, the truck mounting at least one internal combustion engine, each engine having an exhaust for discharging the exhaust gases generated by the internal combustion engine when operating, the hot line pavement striping system including paint storage containers, paint spray guns, and connecting tubing for carrying the paint from the paint storage containers to the paint spray guns, said heating system comprising an exhaust gas collecting conduit secured to the exhaust of each engine for the collection of the exhaust gases generated by each engine and leading to a series of smaller conduits passing through a thermal oil bath, the inner walls of the smaller conduits having sufficient heat exchanging surface and of sufficient number to conduct sufficient heat from the exhaust gases through the conduit walls as the sole source of heat to heat the thermal oil, the exhaust gases after passing through the smaller conduits being exhausted to atmosphere, the thermal oil surrounding paint carrying tubing for heating the paint to be sprayed "hot" from the paint guns, and a heat by-pass to by-pass the exhaust gases and thus the heat past the heating system.

2. The system of claim 1, wherein the smaller conduits passing through a lower portion of the oil bath to cause the heated oil to rise and be replaced by cooler oil, thus causing a convection current with the oil bath, the heated oil in turn being in communication with the outer walls of paint carrying tubing, thereby heating the paint to the desired temperature prior to the paint being conducted to the spray guns.

3. The system of claim 1, wherein at least two internal combustion engines are mounted on the truck, one such engine being used to drive the truck and at least one such engine being part of the compressor used to spray the paint from the guns, and the thermal oil bath is divided into two portions, a portion through which the smaller conduits carrying the exhaust gases pass and a portion through which paint carrying tubing pass for heating the paint.

* * * * *